US007950865B2

(12) United States Patent
Albisetti

(10) Patent No.: US 7,950,865 B2
(45) Date of Patent: May 31, 2011

(54) PACKAGING AND APPLICATOR DEVICE

(75) Inventor: Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 374 days.

(21) Appl. No.: 11/723,662

(22) Filed: Mar. 21, 2007

(65) Prior Publication Data

US 2007/0231055 A1 Oct. 4, 2007

Related U.S. Application Data

(60) Provisional application No. 60/792,323, filed on Apr. 17, 2006.

(30) Foreign Application Priority Data

Mar. 21, 2006 (FR) ..... 06 50970

(51) Int. Cl.
*A46B 11/00* (2006.01)

(52) U.S. Cl. ..... 401/290; 401/269; 401/282

(58) Field of Classification Search ..... 401/84, 401/270, 280, 284, 269, 282, 290
See application file for complete search history.

(56) References Cited

U.S. PATENT DOCUMENTS

| | | | | | |
|---|---|---|---|---|---|
| 2,866,993 | A * | 1/1959 | Edelstone | ..... | 401/100 |
| 2,891,272 | A * | 6/1959 | Grebner et al. | ..... | 401/269 |
| 3,655,290 | A * | 4/1972 | Griffith | ..... | 401/186 |
| 3,739,789 | A * | 6/1973 | Cataneo et al. | ..... | 132/320 |
| 4,040,753 | A | 8/1977 | Griffith | | |
| 4,722,449 | A * | 2/1988 | Dubach | ..... | 215/235 |
| 5,397,195 | A * | 3/1995 | Goncalves | ..... | 401/277 |
| 5,588,447 | A * | 12/1996 | Gueret | ..... | 132/200 |
| 2005/0169696 | A1 | 8/2005 | Albisetti | | |
| 2005/0196220 | A1 * | 9/2005 | Gueret | ..... | 401/129 |
| 2006/0207622 | A1 | 9/2006 | Gueret | | |

FOREIGN PATENT DOCUMENTS

| | | | |
|---|---|---|---|
| EP | 1 557 111 | A1 | 7/2005 |
| EP | 1 702 531 | A2 | 9/2006 |
| FR | 2 155 688 | | 5/1973 |
| FR | 2 867 036 | A1 | 9/2005 |
| WO | WO 88/04148 | | 6/1988 |
| WO | WO 01/76408 | * | 10/2001 |
| WO | WO 01/76408 | A1 | 10/2001 |

* cited by examiner

*Primary Examiner* — David J Walczak
(74) *Attorney, Agent, or Firm* — Oliff & Berridge, PLC

(57) ABSTRACT

The present invention relates to a packaging and applicator device comprising: a reservoir containing at least one composition for application; an applicator element that is secured to the reservoir at least during application; an applicator-element holder; and a support for fastening the applicator-element holder on the reservoir, the support including a tubular sheath surrounding the applicator-element holder and the applicator element over at least a fraction of its length, the tubular sheath and the applicator-element holder presenting facing surfaces in contact; at least one hollow longitudinal channel being formed in one of the surfaces, so as to enable the composition coming from the reservoir to flow towards the applicator element.

28 Claims, 2 Drawing Sheets

PACKAGING AND APPLICATOR DEVICE

This non provisional application claims the benefit of French Application No. 06 50970 filed on Mar. 21, 2006 and U.S. Provisional Application No. 60/792,323 filed on Apr. 17, 2006.

The present invention relates to packaging and applicator devices comprising: a reservoir containing at least one composition for application; and an applicator element that is secured to the reservoir at least during application.

BACKGROUND OF THE INVENTION

European patent application EP 1 557 111 discloses a device of that type in which the applicator element can be constituted by a tuft of bristles stapled in a housing of an applicator-element holder.

The composition is brought to the outside of the applicator element through orifices of the applicator-element holder.

By way of example, the composition can be dispensed by pressing on the wall of the reservoir, when said wall is flexible.

The composition is dispensed at the base of the bristles in a zone in which said bristles are very close to one another, thereby preventing the composition from penetrating easily between them at the base of the bundle.

The bundle of bristles can thus turn out to be insufficiently impregnated in some circumstances.

In addition, there exists the risk of excess composition being delivered onto the applicator element, since once the composition has passed through the orifices of the applicator-element holder, it flows without being braked over the applicator element.

FR 2 155 688 describes a device for dispensing a relatively viscous composition such as a lipstick, the composition being contained in a reservoir provided with a piston and with a mechanism making it possible to displace said piston towards the outlet.

OBJECTS AND SUMMARY OF THE INVENTION

There exists a need to improve still further packaging and applicator devices comprising a reservoir, an applicator element that is secured to said reservoir at least during application, and an applicator-element holder.

The invention seeks to satisfy that need and achieves this by means of a packaging and applicator device comprising:

- a reservoir containing at least one composition for application;
- an applicator element that is secured to the reservoir at least during application;
- an applicator-element holder; and
- a support serving to fasten the applicator-element holder on the reservoir, the support including a tubular sheath surrounding the applicator-element holder and the applicator element over at least a fraction of its length, the tubular sheath and the applicator-element holder presenting facing surfaces in contact.

At least one hollow longitudinal channel may be formed in one of the facing surfaces, so as to enable the composition coming from the reservoir to flow towards the applicator element. A plurality of longitudinal channels may be formed and distributed angularly about the longitudinal axis of the device.

The invention thus makes it possible to create one or more channels of relatively small section between the applicator-element holder and the support, in such a manner as to create a relatively high head loss that is capable of slowing down the flow of composition even in the event of the pressure of the composition in the reservoir being relatively high.

In addition, by surrounding the applicator element, the support makes it possible to create an intermediate chamber into which the longitudinal channel(s) open out, improving the degree to which the bristles are impregnated by the composition.

The quality of the application and the comfort in use are thereby improved, and the invention enables the device to be adapted more easily to a composition presenting given Rheological characteristics, e.g. by selecting the size and the number of longitudinal channels, and the length over which the applicator element is covered by the tubular sheath of the support.

In an embodiment of the invention, the tubular sheath may thus extend around the applicator element over a length of at least 4 millimeters (mm), even of at least 6 mm, 8 mm, or 10 mm, thereby enabling the applicator element to be impregnated in satisfactory manner.

The tubular sheath may be terminated by a converging portion that defines an opening through which the applicator element passes.

The presence of the opening makes it possible to define the outer shape of the applicator element when said applicator element is a bundle of bristles, the shape of the opening being selected as a function of the shape to be given to the bundle of bristles, said bristles coming into contact with the edge of the opening.

The support may be made integrally, in particular by molding a thermoplastic material, with the tubular sheath and with at least one fastener skirt for fastening on the reservoir, in particular a threaded skirt.

The support may also be made with a second threaded skirt, enabling a closure cap to be fastened on the device.

The applicator-element holder may include a housing at one end, enabling a tuft of bristles to be fastened by stapling.

The housing may be centered on the longitudinal axis of the device, and it may present a blind hole.

The housing may present a cross-section that flares towards the outside. By way of example, the housing may present a cone shape in longitudinal section, over at least a fraction of its length.

The flared cross-section of the housing may enable the bristles to move apart from one another more easily outside the housing.

The bristles may thus occupy more of the intermediate chamber, thereby improving their impregnation and slowing down the flow of composition.

The applicator-element holder may be held in the support by friction, in particular by clamping together the above-mentioned surfaces in contact.

The applicator-element holder may be made with longitudinal splines at its periphery, and the support may include a circularly-cylindrical facing surface. In a variant, the support may be made with splines over its inside surface, and the applicator-element holder may present a circularly-cylindrical facing surface.

The support may be made with at least one annular sealing lip that bears against the closure cap when said closure cap is in place on the support.

The support may also be made with an annular sealing lip that bears against a neck of the reservoir.

The support and the reservoir may be made in such a manner as to enable the support to be screwed onto the reservoir, and to prevent the support from being unscrewed therefrom. In particular, at the base of the neck, at least one of the reservoir and of the support may be made with at least a first portion in relief, and the other with at least a second portion in relief that is arranged to co-operate with the first so as to enable screw-tightening while preventing unscrewing. By way of example, the first portion in relief is an anti-rotation ratchet, and the second portion in relief is another anti-rotation ratchet.

The applicator-element holder may be made with a collar that bears axially against a step of the support in such a manner as to limit the degree to which it is driven axially into said support.

The composition contained in the reservoir may be a composition for application to the nails, in particular a nail varnish.

In another of its aspects, the invention also provides a device in which the tubular sheath presents a converging portion that defines an opening through which the applicator element passes, said applicator element being a bundle of bristles that comes into contact with the edge of the opening, regardless of the optional presence of one or more longitudinal channels formed between facing surface of the applicator-element holder and of the support. The bundle of bristles may be fastened in a housing of the applicator-element holder, said housing having a cross-section that flares towards the outside and being cone shaped in longitudinal section, for example.

BRIEF DESCRIPTION OF THE DRAWING

The invention can be better understood on reading the following detailed description of non-limiting embodiments thereof, and on examining the accompanying drawing, in which.

MORE DETAILED DESCRIPTION

Figure 1:
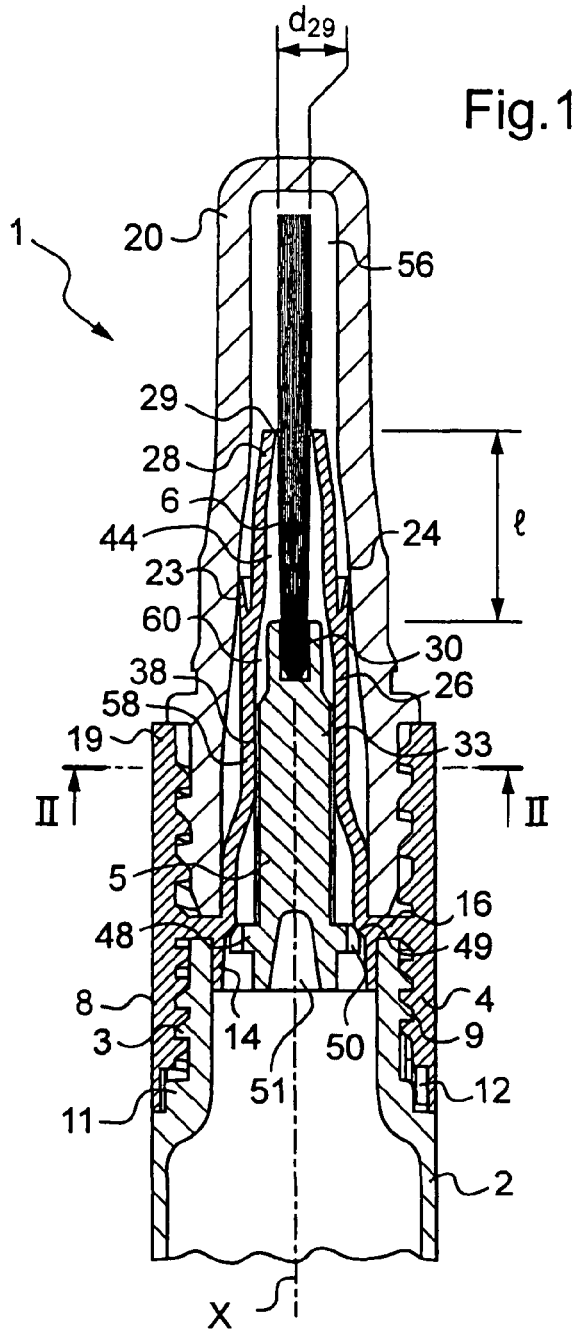
FIG. 1 is a fragmentary and diagrammatic longitudinal section view of an example of a device constituting an embodiment of the invention.

The packaging and applicator device 1 shown in FIG. 1 includes a reservoir 2 of longitudinal axis X containing at least one composition for application, provided with a neck 3 on which there is disposed a support 4 serving to fasten an applicator-element holder 5 on the reservoir 2.

In the embodiment under consideration, the bottom portion of the support 4 comprises a mounting skirt 8 that is internally threaded, and the neck 3 includes a corresponding external thread 9.

At its base, the neck 3 can be made with an anti-rotation ratchet 11, and the mounting skirt 8 can include an anti-rotation ratchet 12 making it possible to screw the mounting skirt 8 onto the reservoir 2, and preventing it from being unscrewed therefrom.

As can be seen in FIG. 1, the support 4 can also include a sealing lip 14 that is engaged in the neck 3 and that is connected to the mounting skirt 8 via a transverse wall 16 that comes to bear against the top end of the neck 3.

At its top portion, the support 4 can comprise an internally-threaded tubular skirt 19 that serves to receive a closure cap 20, which cap can be made of a transparent material.

In the embodiment shown, the support 4 includes an annular sealing lip 23 that bears against an inside surface 24 of the cap 20 when said cap is screwed into the support 4, in such a manner as to define a sealed inside space 56 inside the cap 20, reducing the risk of the composition present on the applicator element 6 drying out while said applicator element is not in use.

The cap 20 can contain composition around the applicator element, where appropriate.

In the embodiment under consideration, the applicator element is a bundle of bristles formed by stapling a tuft of bristles in a housing 30 in the form of a blind hole in the applicator-element holder. In the embodiment under consideration, the housing 30 presents a shape that is generally circularly cylindrical about the longitudinal axis X of the device.

Figure 4:
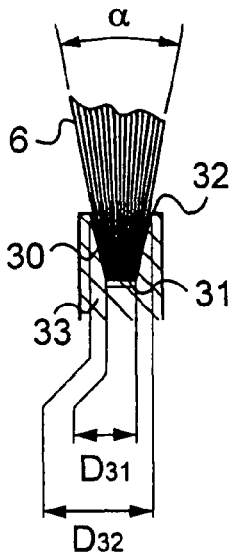
FIG. 4 is an embodiment detail constituting a variant.

In the variant shown in FIG. 4, the housing 30 presents, in longitudinal section, a conical shape.

The flared cross-section of the housing 30 enables the bristles to move apart from one another more easily.

The point angle a of the cone defining the housing 30 is preferably between 15 and 250, preferably of about 20°. The housing 30 presents a circular bottom 31 of diameter $D_{31}$, preferably between 1.5 and 1.9 mm, preferably of about 1.7 mm, and a circular opening 32, the diameter of which is preferably between 2.2 and 2.6 mm, preferably of about 2.4 mm. The bottom 31 and the opening 32 are coaxial of axe X. Advantageously, it is thus possible to obtain a tuft in eventail.

The sealing lip 23 is carried by a tubular sheath 26 of the support 4, which tubular sheath is connected at its bottom to the transverse wall 16, and is extended at its top beyond the applicator-element holder 5, in such a manner as to define an intermediate chamber 44 around the applicator element 6. The intermediate chamber includes an annular space 60 between the sheath 26 and the end of the applicator-element holder 5 including the housing 30.

Figure 5:
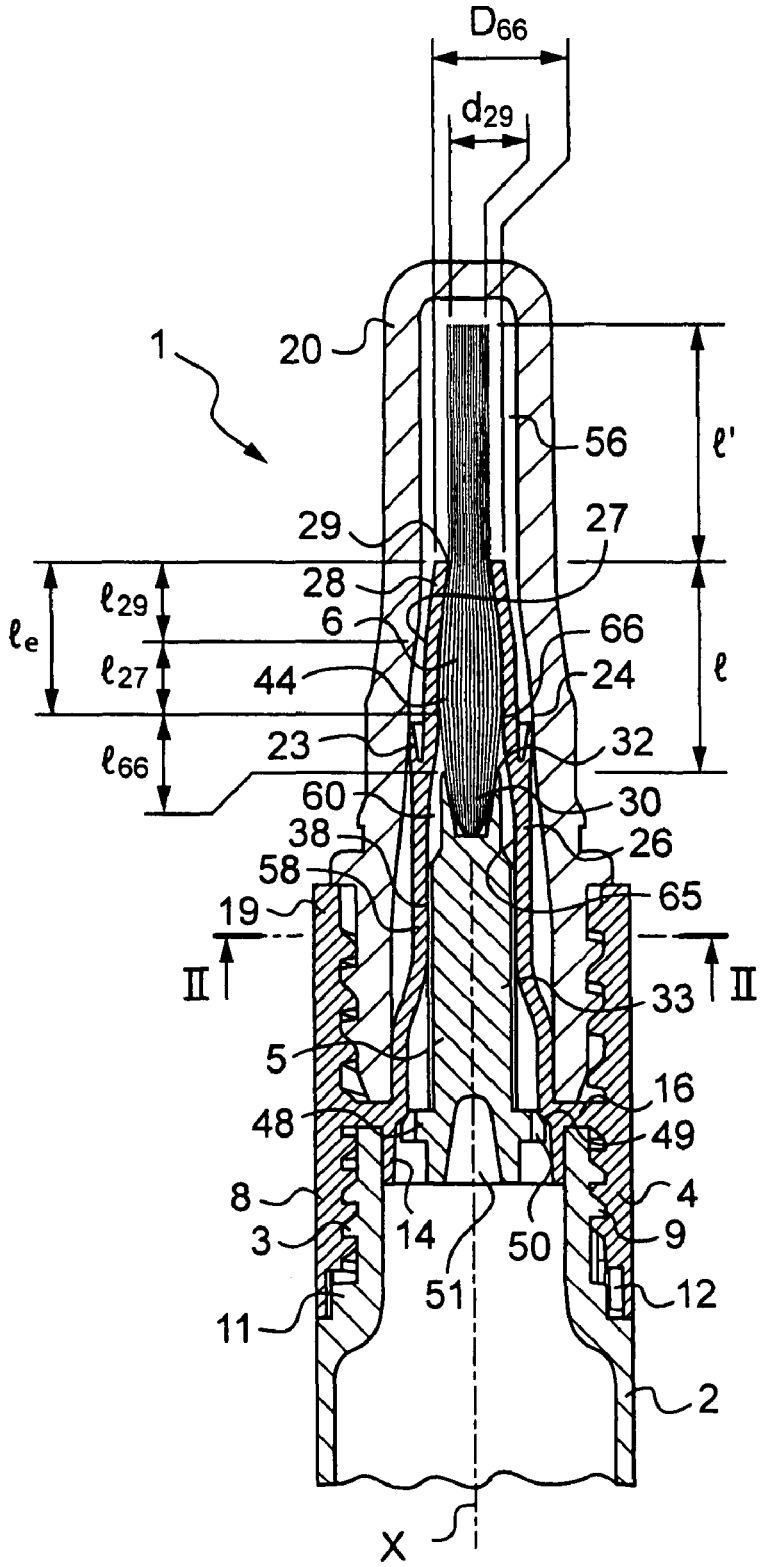
FIG. 5 is a schematic view, in a partial longitudinal cross-section, of a device of the invention using the variant embodiment of FIG. 4.

As represented on FIG. 5, the housing 30 and the intermediate impregnation chamber 44 are preferably configured so that, from an impact line 66 on, the tuft 6 is in contact with the interior surface 65 of the wall delimiting the impregnation chamber 44. Preferably, the distance $l_{66}$, along axe X, between the opening 32 of the housing 30 and the impact line 66 is between 2 and 6 mm, preferably between 3 and 5 mm, preferably of about 4 mm.

The interior diameter $D_{66}$ of the impregnation chamber 44 at the level of the impact line 66 is preferably between 3.6 to 4 mm, preferably of about 3.8 mm.

The tubular sheath 26 presents, starting from a line of rupture 27, a distal portion that is convergent (a converging portion 28), and that defines, at its top end, an opening 29 through which the applicator element 6 passes.

Preferably, the distance, along axe X, between the line of rupture 27 and the opening 29 is between 3 and 4 mm, and preferably is about 3.5 mm.

This distance is referenced as $l_{29}$ on FIG. 5.

In the same way, the distance along axe X between the impact line 66 and the line of rupture 27, referenced $l_{27}$, is preferably between 2.3 and 2.7 mm, preferably of about 2.5 mm.

Because of the shape in eventail of the tuft of bristles 6, and of the progressive throttling of the impregnation chamber 44 towards the opening 29, the tuft of bristles 6 substantially remains in contact with the interior surface 65 delimiting the impregnation chamber from the impact line 66 to the opening 29 on a distance $l_e$ ($=l_{29}+l_{27}$) of at least 4 mm, preferably more than 5 mm and/or less than 8 mm, preferably less than 7 mm, even preferably of about 6 mm.

On this portion of the impregnation chamber, called "contact portion", the tuft of bristles 6 obstructs the impregnation chamber. This obstruction advantageously limits the quantity of product coming out of the opening 29. This configuration also avoids the formation of air bubbles in the tuft of bristles and thus leads to an homogeneous impregnation of said tuft.

By way of example, the opening 29 presents a circular section, preferably presenting a diameter between 2.6 and 3 mm, even preferably of about 2.8 mm, but said section could be different depending on the shape to be given to the applicator element 6.

Preferably, the tuft of bristles 6 extends, beyond the opening 29, out of the impregnation chamber 44, on a length l' between 8 and 11 mm.

Figure 2:
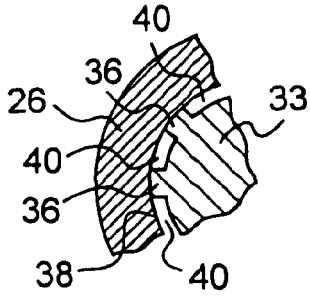
FIG. 2 is a fragmentary cross-section on II-II of FIG. 1.

The applicator-element holder 5 includes a body 33 that presents, on its outside surface, longitudinal splines 36, as can be seen in FIG. 2, that bear against the inside surface 38 of a portion 58 of the tubular sheath 26, which portion is circularly symmetrical about the axis X. Longitudinal channels 40 are thus formed between the tubular sheath 26 and the body 33 of the applicator-element holder, which channels enable the composition contained in the reservoir 2 to flow between the applicator-element holder 5 and the tubular sheath 6 and reach the intermediate chamber 44.

At its bottom portion, the applicator-element holder 5 includes a collar 48 that bears axially against an inner step 49 at the base of the tubular sheath 26, the collar 48 having openings 50 passing therethrough so as to enable composition to flow.

At its bottom end, the body 33 can include a recess 51 that can make it easier to manipulate and to insert in the tubular sheath 26.

In the embodiment under consideration, the applicator-element holder 5 is held by clamping in the tubular sheath 26 by means of splines 36 that bear against the inside surface 38.

The presence of composition in the intermediate chamber 44 enables the bristles outside the housing 30 to be well impregnated, and where appropriate enables the bundle of bristles to expand.

In the embodiment shown, the opening 29 is situated substantially mid-way along the applicator element 6, and said applicator element extends out from the housing 30 over a distance $\ell$ of at least 6 mm, 8 mm, or 10 mm inside the intermediate chamber.

Preferably, the distance l between the opening 32 of the housing 30 and the opening 29 of the impregnation chamber, is between 8 and 12 mm.

It would not be beyond the ambit of the present invention if this were otherwise, e.g. by decreasing or increasing the length of the intermediate chamber 44.

By way of example, the reservoir 2 is made with a flexible wall, thereby enabling the user, by pressing on said wall, to force composition to pass through the longitudinal channels 40.

The presence of the intermediate chamber 44 brakes the flow of composition over the applicator element 6. In addition, in the event of sudden pressure being exerted on the wall of the reservoir 2, the head loss created by flowing through the channels 40 avoids excess composition reaching the applicator element 6 too quickly.

Figure 3:
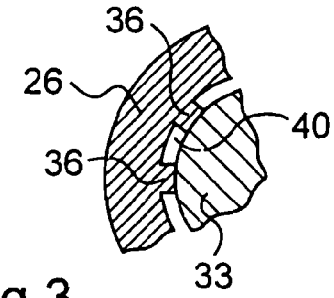
FIG. 3 is a view similar to FIG. 2 showing a variant embodiment.

In the variant in FIG. 3, the splines 36 are formed on the inside surface of the tubular sheath 26, the body 33 presenting a surface facing the splines that is circularly symmetrical about the axis X, for example.

The invention is not limited to the embodiments described above.

For example, the applicator-element holder could be fastened on the reservoir with a support having a different shape.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The term "comprising a" should be understood as being synonymous with the term "comprising at least one" unless specified to the contrary.

What is claimed is:

1. A packaging and applicator device comprising:

a reservoir containing at least one composition for application;

an applicator element that is secured to the reservoir at least during application;

a closure cap;

an applicator-element holder; and a support for fastening the applicator-element holder to the reservoir in a fixed position relative to the reservoir, the support including a tubular sheath surrounding the applicator-element holder, and, beyond the applicator-element holder, surrounding the applicator element over at least a fraction of its length, in such a manner as to define an intermediate impregnation chamber in fluid communication with the reservoir, such that at least a portion of the composition in the intermediate impregnation chamber is in direct contact with the applicator element at least when the closure cap is fastened on the device, the tubular sheath and the applicator-element holder presenting facing surfaces, the facing surfaces being longitudinally parallel where the tubular sheath contacts the applicator-element holder;

at least one hollow longitudinal channel being formed in one of these surfaces, to enable the composition coming from the reservoir to flow towards the applicator element, the tubular sheath being terminated by a converging portion whose interior surface is convergent and defines an opening through which the applicator element passes, and the applicator element being a tuft of bristles that comes into contact with the edge of the opening, and being fastened in a housing of the applicator element holder, the housing presenting a cross-section that flares towards the outside.

2. The device according to claim 1, the tubular sheath extending around the applicator element, beyond the applicator-element holder, over a length of at least 4 mm.

3. The device according to claim 1, the housing presenting a conical shape, in a longitudinal cross-section, over at least a fraction of its length.

4. The device according to claim 1, the support being made integrally with the tubular sheath and with at least one fastener skirt for fastening on the reservoir.

5. The device according to claim 1, the support being made with a threaded skirt, enabling the closure cap to be fastened on the device.

6. The device according to claim 1, said housing enabling said tuft of bristles to be fastened by stapling.

7. The device according to claim 1, the housing being centered on the longitudinal axis of the device.

8. The device according to claim 1, the housing presenting a blind hole.

9. The device according to claim 1, the applicator-element holder being assembled in the support by friction.

10. The device according to claim 9, the applicator-element holder being assembled in the support by friction between the facing surfaces in contact.

11. The device according to claim 1, the applicator-element holder being made with longitudinal splines at its periphery, and the support presenting a circularly-cylindrical facing surface.

12. The device according to claim 1, the support being made with splines over its inside surface, and the applicator-element holder presenting a circularly-cylindrical facing surface.

13. The device according to claim 1, the support being made with at least one annular sealing lip that bears against the closure cap when said closure cap is in place on the support.

14. The device according to claim 1, the support being made with an annular sealing lip that bears against a neck of the reservoir.

15. The device according to claim 1, the support and the reservoir being made in such a manner as to enable the support to be screwed onto the reservoir, while preventing the support from being unscrewed therefrom.

16. The device according to claim 1, the applicator-element holder being made with a collar that bears axially against a step of the support.

17. The device according to claim 1, the housing being at an end of said applicator-element holder.

18. The device according to claim 1, containing a composition for application to the nails.

19. The device according to claim 18, the composition for application to the nails being a nail varnish.

20. The device according to claim 1, the tubular sheath extending around the applicator element, beyond the applicator-element holder, over a length of at least 8 mm.

21. The device according to claim 1, in which the applicator-element holder includes a recess at its bottom end.

22. The device according to claim 1, in which the tuft of bristles is in contact with the interior surface of the converging portion delimiting the impregnation chamber over a length of at least 4 mm.

23. The device according to claim 22, in which the tuft of bristles presents an eventail form and enters into contact with said interior surface according to an impact line.

24. The device according to claim 23, in which the interior diameter of the impregnation chamber, on the level of said impact line, is between 3.6 and 4 mm.

25. The device according to claim 1, in which the housing presents a lateral wall extending according to a cone, the point angle of which is between 15 and 25 degrees.

26. The device according to claim 1, in which the tuft of bristles goes out of the impregnation chamber through the opening presenting a diameter between 2.6 and 3 mm.

27. The device according to claim 1, in which the tuft of bristles extends, outside the impregnation chamber, over a length between 8 and 11 mm.

28. A packaging and applicator device comprising:

a reservoir containing at least one composition for application;

an applicator element that is secured to the reservoir at least during application;

an applicator-element holder; and a support for fastening the applicator-element holder to the reservoir in a fixed position relative to the reservoir, the support including a tubular sheath surrounding the applicator-element holder, and, beyond the applicator-element holder, surrounding the applicator element over at least a fraction of its length, in such a manner as to define an intermediate impregnation chamber to impregnate the applicator element, the tubular sheath and the applicator-element holder presenting facing surfaces, the facing surfaces being longitudinally parallel where the tubular sheath contacts the applicator-element holder;

at least one hollow longitudinal channel being formed in one of these surfaces, to enable the composition coming from the reservoir to flow towards the applicator element, the tubular sheath being terminated by a converging portion whose interior surface is convergent at a portion that contacts the applicator element and defines an opening through which the applicator element passes, and the applicator element being a tuft of bristles that comes into contact with the edge of the opening, and being fastened in a housing of the applicator element holder, the housing presenting a cross-section that flares towards the outside.

* * * * *